US005271505A

United States Patent [19]

Low

[11] Patent Number: 5,271,505

[45] Date of Patent: Dec. 21, 1993

[54] SORTING MACHINE

[75] Inventor: John M. Low, Hertford, England

[73] Assignee: Sortex Limited, London, England

[21] Appl. No.: 934,031

[22] Filed: Aug. 24, 1992

[30] Foreign Application Priority Data

Sep. 3, 1991 [EP] European Pat. Off. ..... 91308053.7

[51] Int. Cl.[5] ..... B07C 5/00

[52] U.S. Cl. ..... 209/587; 209/577; 15/304

[58] Field of Search ..... 209/580, 587, 576, 577, 209/582, 585, 639, 920, 910; 15/304, 312.1, 316.1

[56] References Cited

U.S. PATENT DOCUMENTS 4,340,850 7/1990 Satake ..... 209/580
4,371,081 2/1983 Satake ..... 209/580
5,197,159 3/1993 Truong ..... 15/304

*Primary Examiner*—Robert P. Olszewski
*Assistant Examiner*—Kenneth Noland
*Attorney, Agent, or Firm*—Palmatier, Sjoquist & Helget

[57] ABSTRACT

A sorting machine comprising a transparent tube (16); a material supply member (15) from which material, which is to be sorted into desired and undesired portions, may pass through the transparent tube (16); a light-detector (20) disposed externally of the transparent tube (16) for receiving light from material passing through the latter; a discriminator (21), controlled by the light-detector (20), for discriminating between the desired and undesired portions; a separator (22), controlled by the discriminator (21), for separating the material which has been passed through the transparent tube (16) into the desired and undesired portions; a cleaning member (32); and a movement effecting device (36) for moving the cleaning member (32) against the wall of the transparent tube (16) characterized in that the cleaning member (16) forms part of a cleaning-calibration member (31) which is used in the calibration of the discriminator (21); and there is an actuator (30) operable so that each one of the material supply member (15) and the cleaning-calibration member (31) is at times disposed in an operative position while the other member is in an inoperative position.

10 Claims, 2 Drawing Sheets

SORTING MACHINE

Figure 1:
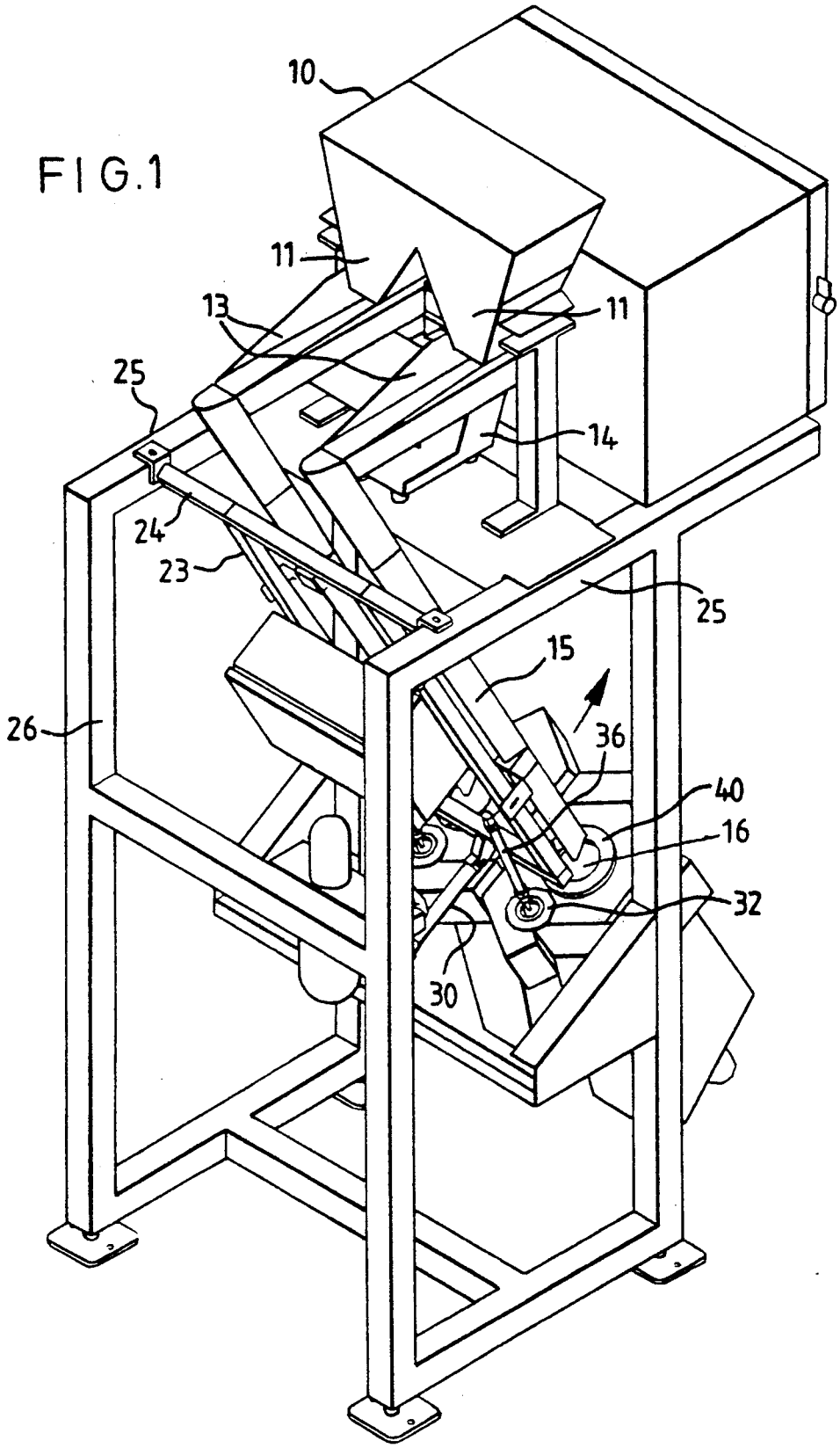

This invention concerns a sorting machine, e.g. a colour sorting machine, for sorting material into desired and undesired portions. The term "material" is used herein in a broad sense as including agricultural material, such as peas, beans, coffee and rice, and mineral material, such as diamonds, coal or pieces of ore. Although the invention is primarily concerned with a colour sorting machine, it is also applicable to other sorting machines which sort by reference to light, e.g. infra-red or ultra-violet light.

In U.S. Pat. No. 4,940,850 there is disclosed a colour sorting machine in which material to be sorted is passed through a transparent tube while viewed by three equiangularly spaced apart light-receiving members. The light-receiving members are arranged to pass signals to electronic circuitry which, on receiving a signal indicative of undesired material, operates an ejector to remove the undesired material. The transparent tube is periodically cleaned by a cleaning member which is moved by an actuator so as to clean the wall of the transparent tube, the cleaning member having a central aperture through which passes the material being sorted.

Although, however, the electronic circuitry employed in the colour sorting machine of U.S. Pat. No. 4,940,850 effects certain corrections such as those for correcting variations in the intensities of the light sources employed, no calibration of the electronic circuitry is effected to restore the latter to a fixed datum so as to correct for drift etc. Moreover, the cleaning member is at all times disposed in the transparent tube and therefore itself constitutes an obstruction to the passage of the material therethrough.

According, therefore, to the present invention, there is provided a sorting machine comprising a transparent tube; a material supply member from which material, which is to be sorted into desired and undesired portions, may pass through the transparent tube; light-detecting means disposed externally of the transparent tube for receiving light from material passing through the latter; discrimination means, controlled by the light-detecting means, for discriminating between the said desired and undesired portions; separator means, controlled by the discrimination means, for separating the material which has been passed through the transparent tube into the said desired and undesired portions; a cleaning member; and moving means for moving the cleaning member so as to clean the wall of the transparent tube characterised in that the cleaning member forms part of a cleaning-calibration member, there being means for using the cleaning-calibration member in the calibration of the discrimination means; and actuating means to effect relative movement of the material supply member and the cleaning-calibration member so that each of said members is at times disposed in an operative position while the other member is in an inoperative position.

Preferably, each said material supply member and cleaning-calibration member is carried by a common frame and there are actuating means which in operation periodically moves the common frame into and out of a first position in which a part of the material supply member is in an operative position in which it is aligned with a part of the transparent tube and the cleaning-calibration member is in its inoperative position in which it is not aligned with the said part of the transparent tube so that it does not impede the passage of the said material through the transparent tube, the actuating means also in operation periodically moving the common frame into and out of a second position in which the cleaning-calibration member is in its operative position in which it is aligned with the transparent tube and the material supply member is in its inoperative position in which it does not impede cleaning movement of the cleaning member over the wall of the transparent tube.

Means are preferably provided for interrupting the supply of material to the material supply member whenever the latter is in the inoperative position.

There are preferably means for supplying a cleaning fluid e.g. air, to the wall of the transparent tube, and means dependent upon the position of the cleaning member for periodically increasing the pressure of the cleaning fluid for a predetermined period. Thus the said pressure may be increased when the cleaning member has completed its cleaning action.

There are preferably means for periodically disposing each of said members in its operative position for a predetermined length of time.

Alternatively, there is a light-sensitive device responsive to the degree of cleanliness of the said wall of the transparent tube, the said light sensitive device causing movement of the cleaning-calibration member into its operative position whenever the said degree of cleanliness is inadequate.

The cleaning-calibration member preferably comprises a light-reflecting calibration block which is fixed, directly or indirectly, to the cleaning member.

The light-detecting means preferably comprise at least three light-sensitive members which are arranged to receive light emanating in a corresponding number of different directions from the material passing through the transparent tube.

The machine may have a plurality of channels each of which is provided with a respective transparent tube, material supply member, light-detecting means, and cleaning member.

Figure 2:
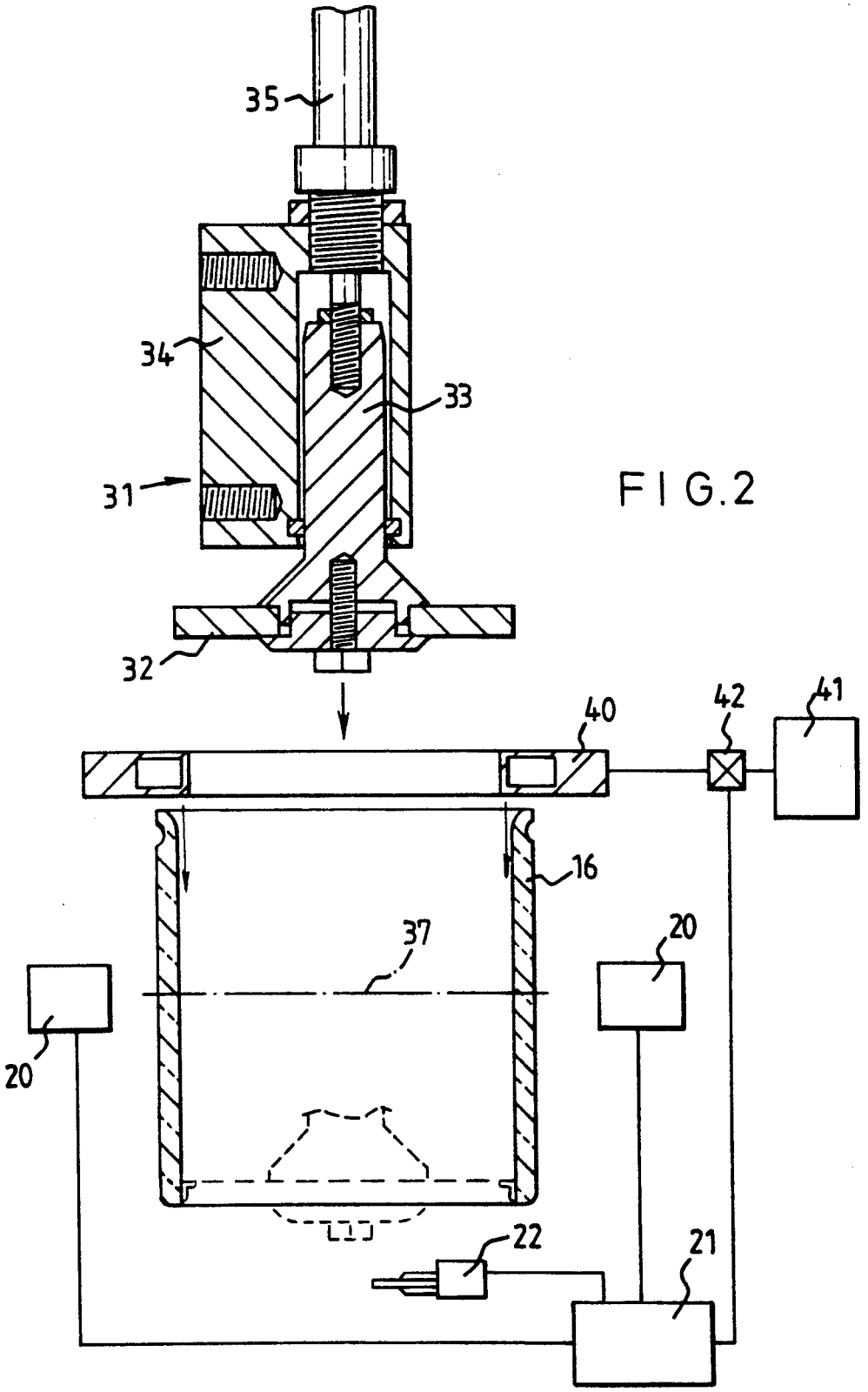

The invention is illustrated, merely by way of example, in the accompanying drawings, in which:

FIG. 1 is a perspective view of a sorting machine according to the present invention, and FIG. 2 is a partly diagrammatic sectional view of a part of the sorting machine shown in FIG. 1.

Referring to the drawings, a two-channel colour sorting machine comprises a hopper 10 for holding material, e.g. peas or beans, which are to be sorted into desired and undesired portions in accordance with their colour, e.g. the extent to which they reflect red and green light. The hopper 10 has two outlet portions 11. The material may pass from each outlet portion 11 to the upper end of a respective substantially horizontal delivery chute 13. The latter are arranged to be vibrated by a common electro-magnetic vibrator 14 so as to cause the material to travel to the output end of each delivery chute 13 and then to pass to the upper end of a respective downwardly inclined material supply chute 15. When the material supply chutes 15 are in the operative positions shown in FIG. 1, their lower ends are aligned with respective transparent tubes 16 so that the material to be sorted may fall under gravity therethrough. The transparent tubes 16 may, for example, be made of glass.

The material passing through each transparent tube 16 is illuminated by one or more lamps (not shown) and is viewed by three respective equi-angularly spaced apart light-sensitive members 20 (FIG. 2) which are arranged to receive and to be responsive to light (e.g. red and green light) emanating in a corresponding number of different directions from the material passing through the respective transparent tube 16. Signals from the light-sensitive members 20 are passed to a microprocessor 21 which includes a discriminator (not shown) for discriminating between signals derived from desired and undesired portions respectively of the material passing through each transparent tube 16. When discoloured or otherwise undesired material is detected as passing through a transparent tube 16, the microprocessor 21 sends an operation signal to open a valve (not shown) of an ejector unit 22 so that, after an appropriate delay, a puff of air is directed onto the undesired material so as to remove it from the remaining material.

The material supply chutes 15 are carried by a downwardly inclined chute frame 23 which has at its upper end a support member 24. Opposite ends of the support member 24 are pivotally mounted in wall members 25 of a machine main frame 26. An hydraulically or pneumatically operated actuating cylinder 30 is pivotally connected at one end thereof to the machine main frame 26. The actuating cylinder 30 has a piston (not shown) pivotally connected to the chute frame 23. When the said piston is retracted, the chute frame 23 is in a first position, as shown in FIG. 1, in which the lower ends of the material supply chutes 15 are aligned with the tops of the transparent tubes 16 so that material may be delivered to the latter. In the said first position, cleaning-calibration members 31 (FIG. 2) which are carried by the chute frame 23, are disposed in inoperative positions in which they are not aligned with the transparent tubes 16 so that they do not impede the passage of the material through the transparent tubes 16.

Each cleaning-calibration member 31 comprises a wiper brush 32 which is secured to the lower end of a light-reflecting white or otherwise coloured calibration block 33. Each cleaning-calibration member 31 is mounted in a housing 34 which is arranged to be moved by a piston 35 of an hydraulically or pneumatically actuated wiper cylinder 36, the latter being carried by the chute frame 23.

The actuating cylinder 30 is periodically actuated to cause pivotal movement of the chute frame 23 so as to pivot the latter periodically between the said first position thereof and a second position (not shown). In the said second position, each wiper brush 32 is aligned with its respective transparent tube 16 so that, on operation of the piston 35, the wiper brush 32 is moved down and up in contact with the wall of the transparent tube 16 so as to clean the said wall. In the said second position, each material supply chute 15 is an inoperative position in which it does not impede the down and up cleaning movement of the wiper brush 32 over the wall of the transparent tube 16.

When the wiper brush 32 is in its dotted line position, the calibration block 33 is disposed in the viewing plane 37 in which it is viewed by a sensor (not shown). The sensor is arranged to send a signal to a calibration circuit (not shown) forming part of the microprocessor 21 so that the latter is calibrated to a fixed datum so as to offset the effect of drift, ageing of the lamps, variations in the current supply and so on. Thus in each position of the chute frame 23, the material supply chutes 15 and cleaning-calibration members 31 are respectively in operative and inoperative positions or vice versa.

Although calibration may be effected after the wiper brush 32 has travelled once only in its cleaning movement over the wall of the transparent tube 16, it is preferred that the wiper brush 32 has made three (i.e. down-up-down) cleaning movements over the said wall before calibration occurs.

Mounted above each transparent tube 16 is a blowdown ring 40 which is supplied with compressed air from a source 41 via a pressure reducing valve 42. The latter is movable under the control of the microprocessor 21 between a low pressure position in which low pressure air is supplied to the blowdown ring 40 and a high pressure position in which high pressure air is supplied to the blowdown ring 40. The microprocessor 21 is programmed so that, immediately the wiper brush 32 has completed its cleaning action and has been removed from the transparent tube 16, a blast of high pressure air is directed over the wall of the transparent member 16 and thereafter a flow of low pressure air is passed over the said wall.

The microprocessor 21 may be arranged, periodically to dispose each of the parts 15, 31 in its operative position for a predetermined length of time.

Alternatively, a light-sensitive device 29 may be provided which is responsive to the degree of cleanliness of the wall of each transparent tube 16. The light-sensitive device 27 may be connected to the microprocessor 21 so that the chute frame 23 is moved into its said second position (whereby the cleaning-calibration member 31 is brought into its operative position) whenever the said degree of cleanliness is inadequate.

When the chute frame 23 is in its said second position, the microprocessor 21 turns off the vibrator 14 so that the supply of material is interrupted.

I claim:

1. A sorting machine comprising a transparent tube; a material supply member from which material, which is to be sorted into desired and undesired portions, may pass through the transparent tube; light-detecting means disposed externally of the transparent tube for receiving light from material passing through the latter; discrimination means, controlled by the light-detecting means, for discriminating between the said desired and undesired portions; separator means, controlled by the discrimination means, for separating the material which has been passed through the transparent tube into the said desired and undesired portions; a cleaning-calibration member; moving means for moving the cleaning-calibration member so as to clean the wall of the transparent tube; means for using the cleaning-calibration member in the calibration of the discrimination mean; and actuating means for effecting relative movement of the material supply member and the cleaning-calibration member, said actuating means being settable in a first state in which the cleaning-calibration member is in an operative position in which it can effect cleaning of the transparent tube and in which the material supply tube is in an inoperative position in which it cannot supply material to the transparent tube; said actuating means being settable in a second state in which the cleaning-calibration member is in an inoperative position in which it cannot effect cleaning of the transparent tube and in which the material supply member can supply material to the transparent tube.

2. A sorting machine as claimed in claim 1 in which there are means for interrupting the supply of material to the material supply member whenever the latter is in the inoperative position.

3. A sorting machine as claimed in claim 1 in which the light-detecting means comprise at least three light-sensitive members which are arranged to receive light emanating in a corresponding number of different directions from the material passing through the transparent tube.

4. A sorting machine as claimed in claim 1 in which the machine has a plurality of channels each of which is provided with a respective transparent tube, material supply member, light-detecting means and cleaning-calibration member.

5. A sorting machine comprising a transparent tube; a material supply member from which material, which is to be sorted into desired and undesired portions, may pass through the transparent tube; light-detecting means disposed externally of the transparent tube for receiving light from material passing through the latter; discrimination means, controlled by the light-detecting means, for discriminating between the said desired and undesired portions; separator means, controlled by the discrimination means, for separating the material which has been passed through the transparent tube into the said desired and undesired portions; a cleaning-calibration member; moving means for moving the cleaning-calibration member so as to clean the wall of the transparent tube; means for using the cleaning-calibration member in the calibration of the discrimination means; actuating means operable so that each one of the material supply member and the cleaning-calibration member is at times disposed in an operative position while the other member is in an inoperative position; means for supplying a cleaning fluid to the wall of the transparent tube; and means dependent upon the position of the cleaning-calibration member for periodically increasing the pressure of the cleaning fluid for a predetermined period.

6. A sorting machine as claimed in claim 5 in which the said pressure is increased when the cleaning-calibration member has completed its cleaning action.

7. A sorting machine comprising a transparent tube; a material supply member from which material, which is to be sorted into desired and undesired portions, may pass through the transparent tube; light-detecting means disposed externally of the transparent tube for receiving light from material passing through the latter; discrimination means, controlled by the light-detecting means, for discriminating between the said desired and undesired portions; separator means, controlled by the discrimination means, for separating the material which has been passed through the transparent tube into the said desired and undesired portions; a cleaning-calibration member; a common frame which carries the material supply member and the cleaning-calibration member so as to clean the wall of the transparent tube; means for using the cleaning-calibration member in the calibration of the discrimination means; and actuating means which in operation periodically moves the common frame into and out of a first position in which a part of the material supply member is in an operative position in which it is aligned with a part of the transparent tube and the cleaning-calibration member is in its inoperative position in which it is not aligned with the said part of the transparent tube so that it does not impede the passage of the said material through the transparent tube, the actuating means also in operation periodically moving the common frame into and out of a second position in which the cleaning-calibration member is in its operative position in which it is aligned with the transparent tube and the material supply member is in its inoperative position in which it does not impede cleaning movement of the cleaning-calibration member over the wall of the transparent tube.

8. A sorting machine comprising a transparent tube; a material supply member from which material, which is to be sorted into desired and undesired portions, may pass through the transparent tube; light-detecting means disposed externally of the transparent tube for receiving light from material passing through the latter; discrimination means, controlled by the light-detecting means, for discriminating between the said desired and undesired portions; separator means, controlled by the discrimination means, for separating the material which has been passed through the transparent tube into the said desired and undesired portions; a cleaning-calibration member; moving means for moving the cleaning-calibration member so as to clean the wall of the transparent tube; means for using the cleaning-calibration member in the calibration of the discrimination means; actuating means operable so that each one of the material supply member and the cleaning-calibration member is at times disposed in an operative position while the other member is in an inoperative position; and means for periodically disposing each of said members in its operative position for a predetermined length of time.

9. A sorting machine comprising a transparent tue; a material supply member from which material, which is to be sorted into desired and undesired portions, may pass through the transparent tube; light-detecting means disposed externally of the transparent tube for receiving light from material passing through the latter; discrimination means, controlled by the light-detecting means, for discriminating between the said desired and undesired portions; separator means, controlled by the discrimination means, for separating the material which has been passed through the transparent tube into the said desired and undesired portions; a cleaning-calibration member; moving means for moving the cleaning-calibration member so as to clean the wall of the transparent tube; means for using the cleaning-calibration member in the calibration of the discrimination means; actuating means operable so that each one of the material supply member and the cleaning-calibration member is at times disposed in an operative position while the other member is in an inoperative position; and a light-sensitive device responsive to the degree of cleanliness of the said wall of the transparent tube, the said light-sensitive device causing movement of the cleaning-calibration member into its operative position whenever the said degree of cleanliness is inadequate.

10. A sorting machine comprising a transparent tube; a material supply member from which material, which is to be sorted into desired and undesired portions, may pass through the transparent tube; light-detecting means disposed externally of the transparent tube for receiving light from material passing through the latter; discrimination means, controlled by the light-detecting means, for discriminating between the said desired and undesired portions; separator means, controlled by the discrimination means, for separating the material which has been passed through the transparent tue into the said desired and undesired portions; a cleaning-calibration member which comprises a light-reflecting calibration block which is fixed, directly or indirectly, to a cleaning member; moving means for moving the cleaning-calibration member so that the cleaning member cleans the wall of the transparent tube; means for using the calibration block in the calibration of the discrimination means; and actuating means operable so that each one of the material supply member and the cleaning-calibration member is at times disposed in an operative position while the other member is in an inoperative position.

* * * * *

UNITED STATES PATENT AND TRADEMARK OFFICE

CERTIFICATE OF CORRECTION

PATENT NO. : 5,271,505

DATED : December 21, 1993

INVENTOR(S) : John M. Low

It is certified that error appears in the above-identified patent and that said Letters Patent is hereby corrected as shown below:

On the Title page, item [56] References Cited: "4,340,850" should be -- 4,940,850 --.

Column 4, line 27, "27" should be -- 29 --.

Claim 9, column 6, line 28, "tue" should be -- tube --.

Claim 10, column 6, line 63, "tue" should be -- tube --.

Signed and Sealed this

Twenty-fourth Day of May, 1994

Bruce Lehman

*Attest:*

BRUCE LEHMAN

*Attesting Officer*

*Commissioner of Patents and Trademarks*